US011419469B2

(12) United States Patent
Hyun et al.

(10) Patent No.: US 11,419,469 B2
(45) Date of Patent: Aug. 23, 2022

(54) CLEANER

(71) Applicant: LG ELECTRONICS INC., Seoul (KR)

(72) Inventors: Kietak Hyun, Seoul (KR); Jonguk Her, Seoul (KR); Soohan Eo, Seoul (KR); Sangchul Lee, Seoul (KR); Inkyu Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 181 days.

(21) Appl. No.: 16/861,913

(22) Filed: Apr. 29, 2020

(65) Prior Publication Data

US 2021/0259492 A1 Aug. 26, 2021

(30) Foreign Application Priority Data

Feb. 25, 2020 (KR) ..... 10-2020-0022975

(51) Int. Cl.
*A47L 9/16* (2006.01)
*A47L 9/12* (2006.01)
(Continued)

(52) U.S. Cl.
CPC ..... *A47L 9/1625* (2013.01); *A47L 5/24* (2013.01); *A47L 9/102* (2013.01); *A47L 9/127* (2013.01);
(Continued)

(58) Field of Classification Search
CPC .... A47L 9/1608; A47L 9/1616; A47L 9/1641; A47L 9/1658; A47L 9/1666;
(Continued)

(56) References Cited

U.S. PATENT DOCUMENTS 10,080,473 B2 9/2018 Conrad
2011/0005029 A1 1/2011 Lee
(Continued)

FOREIGN PATENT DOCUMENTS

CN 103405195 11/2013
CN 204260668 4/2015
(Continued)

OTHER PUBLICATIONS

United States Office Action dated Nov. 12, 2021 issued in co-pending related U.S. Appl. No. 16/861,954.
(Continued)

*Primary Examiner* — David Redding
(74) *Attorney, Agent, or Firm* — Ked & Associates LLP

(57) ABSTRACT

A cleaner includes a hollow cylindrical housing; a housing wall dividing an internal space of the housing into a first space and a second space; a wall through-hole defined to pass through the housing wall; a mounting portion including a mounting body having a top face and a mounting space defined therein in communication with the second space, the mounting body being fixed into the wall through-hole; first openings defined in a first region of the bottom face, and second openings defined in a second region of the bottom face; a separator disposed in the first space to form a flow path for guiding air to the plurality of openings, and a filter that includes a filter body located in the mounting space, and filter faces to filter the air flowing through the first openings and second openings.

16 Claims, 11 Drawing Sheets

(51) Int. Cl.

| | |
|---|---|
| ***A47L 5/24*** | (2006.01) |
| ***A47L 9/10*** | (2006.01) |
| ***A47L 9/20*** | (2006.01) |
| ***A47L 9/22*** | (2006.01) |
| ***A47L 9/28*** | (2006.01) |
| ***A47L 9/14*** | (2006.01) |

(52) U.S. Cl.
CPC ..... *A47L 9/149* (2013.01); *A47L 9/165* (2013.01); *A47L 9/1683* (2013.01); *A47L 9/20* (2013.01); *A47L 9/22* (2013.01); *A47L 9/2884* (2013.01)

(58) Field of Classification Search
CPC ..... A47L 9/1683; A47L 9/12; A47L 9/125; A47L 9/127; B04C 2009/004
See application file for complete search history.

(56) References Cited

U.S. PATENT DOCUMENTS

| | | | | |
|---|---|---|---|---|
| 2011/0265283 | A1* | 11/2011 | Duncan | A47L 9/14 15/347 |
| 2015/0007732 | A1* | 1/2015 | Hasenfratz | B01D 46/523 96/134 |
| 2017/0280950 | A1 | 10/2017 | Nam et al. | |
| 2017/0280959 | A1 | 10/2017 | Nam et al. | |
| 2019/0183300 | A1 | 6/2019 | Yuen et al. | |
| 2019/0183305 | A1 | 6/2019 | Lawson McLean et al. | |
| 2019/0335965 | A1 | 11/2019 | Yang et al. | |
| 2020/0008636 | A1 | 1/2020 | Lee et al. | |
| 2020/0037834 | A1 | 2/2020 | Li et al. | |

FOREIGN PATENT DOCUMENTS

| | | | | |
|---|---|---|---|---|
| CN | 106618374 | | 5/2017 | |
| CN | 108030439 | | 5/2018 | |
| CN | 109862817 | | 6/2019 | |
| KR | 10-2011-0004519 | | 1/2011 | |
| KR | 10-2022098 | | 9/2019 | |
| KR | 10-2019-0127137 | | 11/2019 | |
| KR | 10-2019-0136645 | | 12/2019 | |
| KR | 20190136645 | A * | 12/2019 | B04C 5/185 |
| KR | 10-2020-0004046 | | 1/2020 | |
| TW | 201735849 | | 10/2017 | |
| TW | 201946584 | | 12/2019 | |
| TW | 202000110 | | 1/2020 | |
| WO | WO 2019/105142 | | 6/2019 | |
| WO | WO 2019/122802 | | 6/2019 | |
| WO | WO 2019/122812 | | 6/2019 | |

OTHER PUBLICATIONS

International Search Report and Written Opinion dated Nov. 3, 2020 issued in International Application No. PCT/KR2020/005347.
International Search Report and Written Opinion dated Nov. 25, 2020 issued in International Application No. PCT/KR2020/005345.
Taiwanese Office Action (with English translation) dated Nov. 26, 2020 issued in TW Application No. 109113897.
Taiwanese Office Action (with English translation) dated Nov. 26, 2020 issued in TW Application No. 109113898.
Korean Office Action dated Mar. 2, 2021 issued in KR Application No. 10-2020-0022978.
U.S. Appl. No. 16/861,913, filed Apr. 29, 2020.
U.S. Appl. No. 16/861,954, filed Apr. 29, 2020.

* cited by examiner

CLEANER

CROSS-REFERENCE TO RELATED APPLICATIONS

This application claims priority under 35 U.S.C. § 119 to Korean Application No. 10-2020-0022975 filed on Feb. 25, 2020, whose entire disclosure is hereby incorporated by reference. This application is also related to U.S. application Ser. No. 16/861,954 filed Apr. 29, 2020, whose entire disclosure is also hereby incorporated by reference.

BACKGROUND

1. Field

The present disclosure relates to a cleaner.

2. Background

A cleaner is an appliance that sucks dusts or foreign matters to clean the room. A conventional cleaner generally includes a housing having an intake port and an exhaust hole, a fan for flowing air flowed into the intake port to the exhaust hole, a separator for separating the foreign matters from the air flowing by the fan, a filter located between the separator and the fan to filter the foreign matters from the air passed through the separator, and a handle disposed on the housing.

In a case of the above-mentioned conventional cleaner, most of the foreign matters contained in the air are separated from the air through the separator and stored in the housing, and the foreign matters contained in the air passed through the separator are separated from the air while passing through the filter. Accordingly, it may be seen that, the larger the volume of a storage space of the foreign matters defined in the housing, the greater the filtration capacity of the cleaner. However, when an amount of foreign matters remaining in filters is large, the filters will be a flow path resistance that reduces a flow rate of the air flowing to the fan. Thus, in some cases, a filtration capacity of the filters, rather than the volume of the housing, may become a factor that determines a filtration capacity of an entirety of the cleaner.

BRIEF DESCRIPTION OF THE DRAWINGS

The embodiments will be described in detail with reference to the following drawings in which like reference numerals refer to like elements wherein.

DETAILED DESCRIPTION

Figure 1:
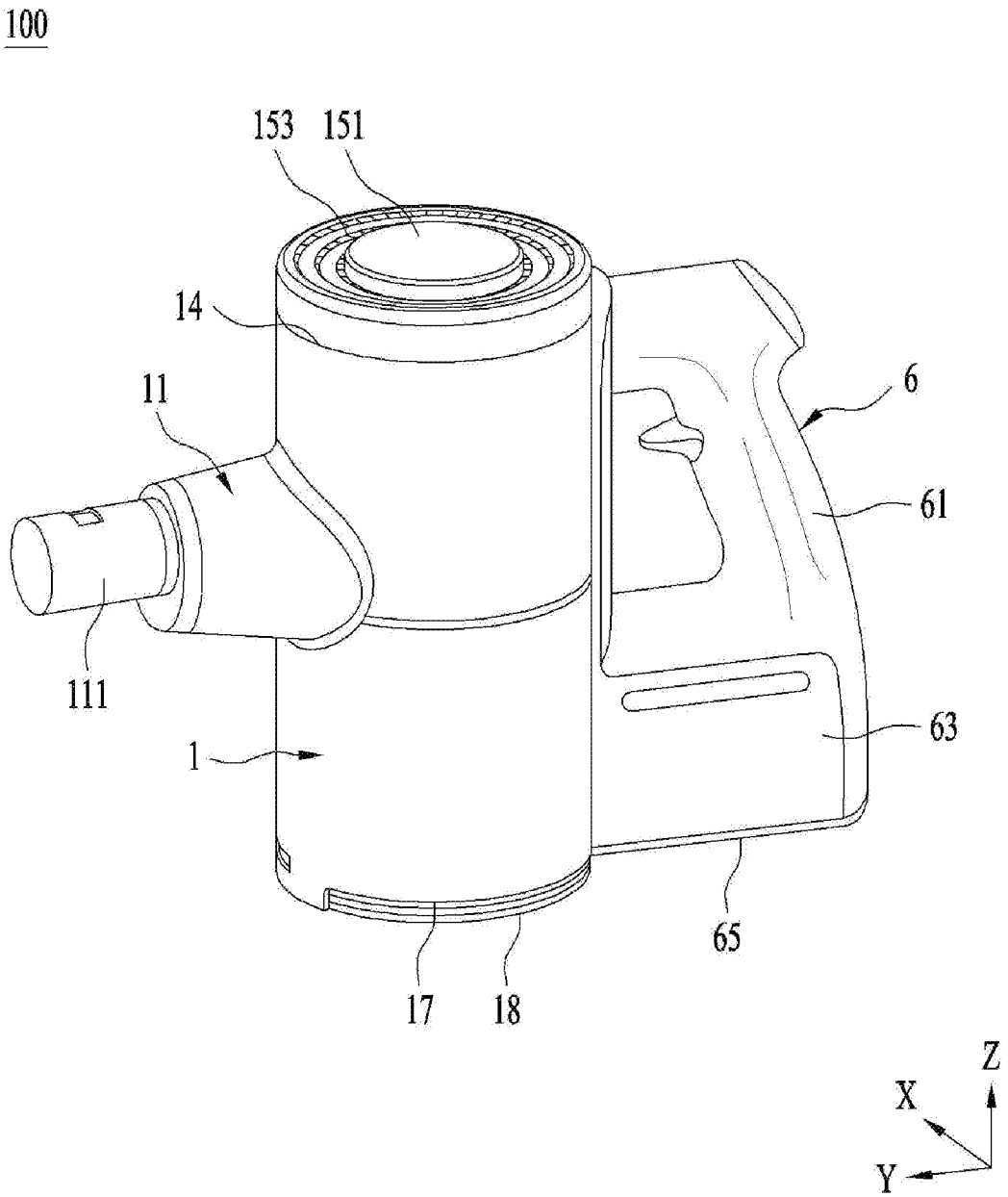
FIGS. 1 and 2 illustrate an example of a cleaner.

Hereinafter, a preferred embodiment of a cleaner will be described in detail with reference to the drawings. A configuration or a method for controlling an apparatus to be described below is only for describing an embodiment of the present application, and is not intended to limit the scope of the present application. Further, like reference numerals throughout the specification indicate like components.

FIG. 1 illustrates an example of a cleaner 100. The cleaner 100 includes a housing 1 formed in a form of a cylinder with a hollow therein, an intake port 11 formed on the housing 1 and an exhaust hole 153 defined in the housing 1, a fan 5 disposed inside the housing 1 to flow air from the intake port 11 to the exhaust hole 153, a separator 4 for guiding the air flowed into the intake port 11 to the fan 5, and separating foreign matters from the air using a centrifugal force, and a handle 6 disposed on the housing 1 such that a user may grab the handle 6 with a hand. The handle 6 may be positioned at a point that is symmetrical with (180 degrees apart from) a point where the intake port 11 is located in a space provided by a circumferential face of the housing 1.

Figure 2:
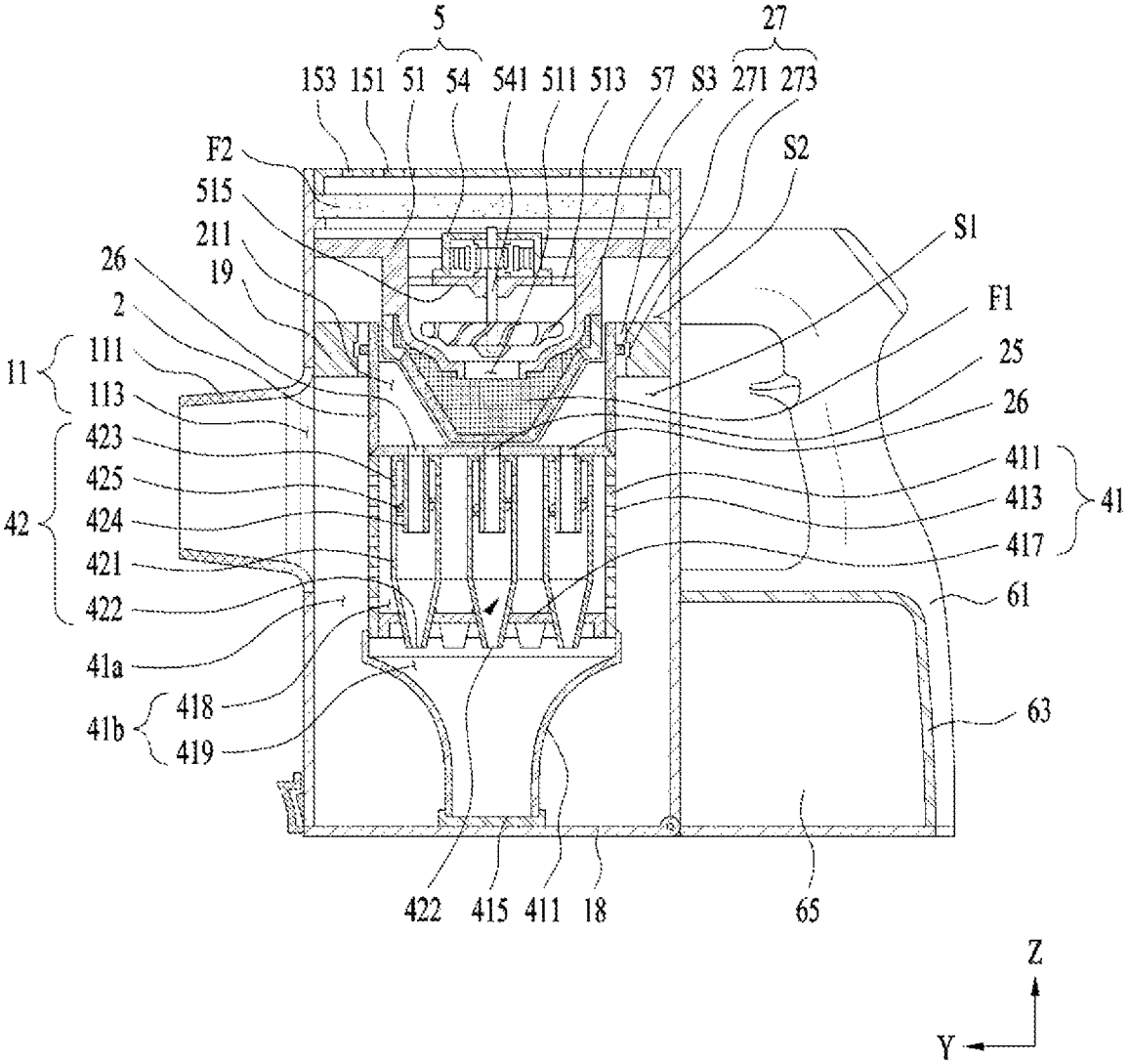

As shown in FIG. 2, a housing wall 19 for dividing an internal space of the housing into a lower space (a first space, S1) and an upper space (a second space, S2) of the housing is disposed inside the housing 1. Further, the housing wall 19 includes a wall through-hole S3 for communicating the first space S1 and the second space S2 with each other defined therein.

The intake port 11 is disposed on a circumferential face of the housing 1 to flow outside air into the first space S1. The intake port 11 may include an intake hole 113 defined to penetrate the circumferential face of the housing 1, and an intake pipe 111 extending from the intake hole 113 in a direction to be farther away from a center of the housing 1 (a direction farther away from the handle, a Y-axis direction). Although not shown in the drawings, the cleaner of the present disclosure may further include an extended pipe detachably disposed on the intake pipe 111, and a nozzle disposed at a free end of the extended pipe to flow the foreign matters to the extended pipe.

The exhaust hole 153 is defined to penetrate a top face or a circumferential face of the housing 1 to exhaust air in the second space S2 to the outside of the housing 1. Further, FIG. 2 illustrates an example in which the exhaust hole 153 is defined in the top face of the housing 1.

A housing through-hole 14 (see FIG. 1) may be defined in the top face of the housing 1, and the housing through-hole 14 may be defined to be opened and closed by an upper cover 151. A second filter F2 for filtering the air discharged from the fan 5 may be disposed inside the housing, and the user may separate the second filter F2 from the housing 1 by separating the upper cover 151 from the housing through-hole 14. The upper cover 151 may be disposed in a shape corresponding to a shape of the housing through-hole 14, and the exhaust hole 153 may include a plurality of holes penetrating the upper cover 151.

A housing outlet 17 (see FIG. 1) for discharging the foreign matters stored in the housing 1 to the outside is further defined in a bottom face (one face of the housing opposite to the face in which the exhaust hole 153 is defined) of the housing 1. The housing outlet 17 is opened and closed by a lower cover 18. The lower cover 18 may be rotatably fixed to the housing 1.

A mounting portion (or mount) 2 is disposed inside the wall through-hole S3. The mounting portion 2 is for providing a mounting space 211 in which a first filter F1 to be described below is mounted. The mounting portion 2 may be disposed as a mounting body 21 detachably fixed to the housing wall 19 and positioned inside the wall through-hole S3.

The mounting body 21 may be disposed in a cylindrical or faceted cylindrical shape having a hollow therein. FIG. 2 illustrates an example in which the mounting body 21 is formed in a cylindrical shape in which the mounting space 211 is defined.

Figure 3:
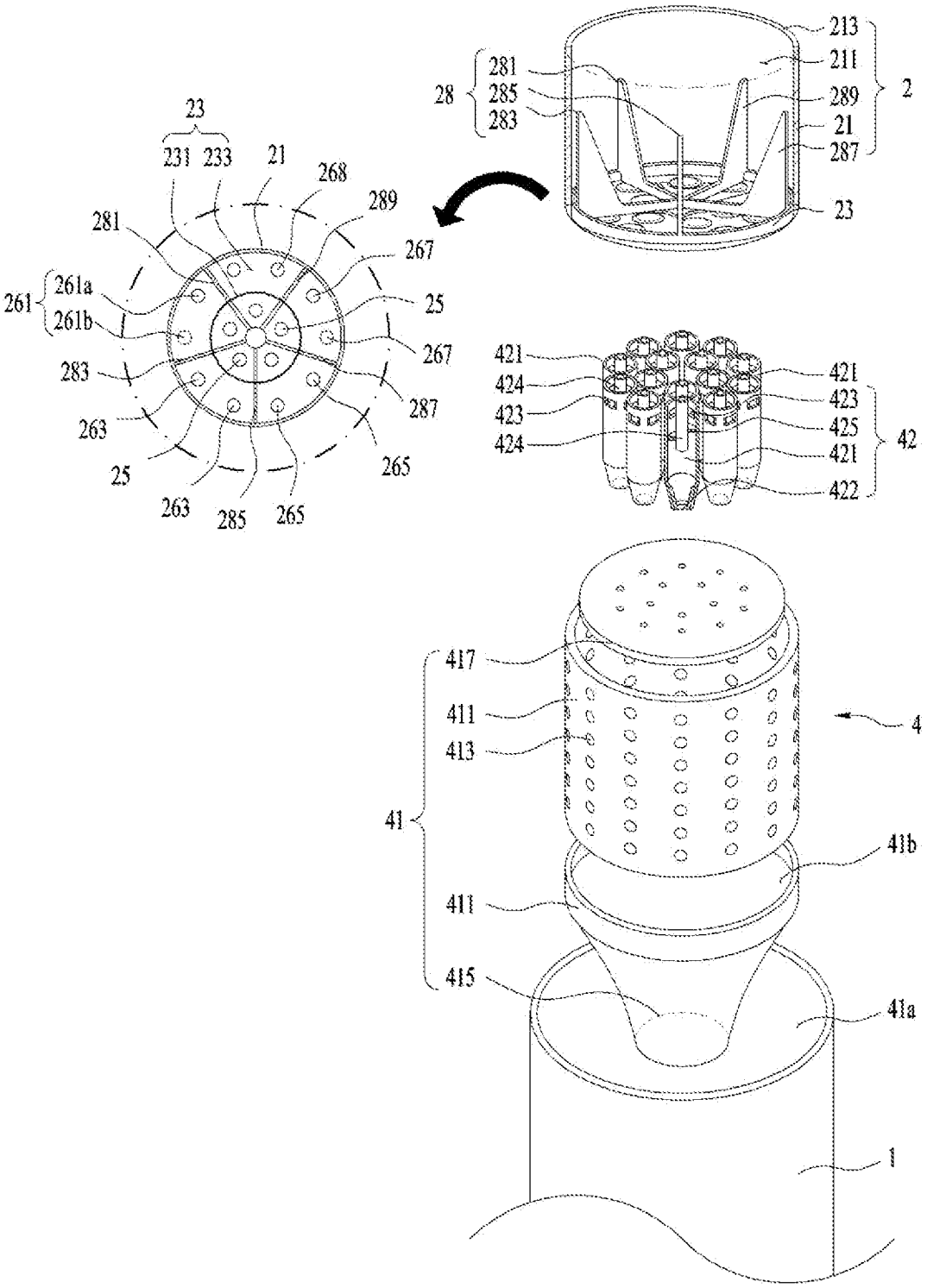
FIGS. 3 and 4 illustrate an example of a separator disposed in a cleaner.

As shown in FIG. 3, a top face through-hole 213 for communicating the mounting space 211 and the second space S2 with each other is defined in a top face of the mounting body 21, and first communicating openings 25 and second communicating openings 26 for communicating the mounting space 211 with the first space S1 are defined in a bottom face 23 of the mounting body.

The bottom face 23 is divided into a first region 231 including a center of the bottom face, and a ring-shaped second region 233 surrounding the first region. The first communicating openings 25 is defined in the first region 231, and the second communicating openings 26 is defined in the second region 233.

The first communicating openings 25 may be defined as one hole penetrating the bottom face 23, or may be defined as a plurality of holes defined in the first region 231. Similarly, the second communicating openings 26 may be defined as one hole or a plurality of holes defined in the second region 233.

The mounting body 21 is detachably coupled to the housing wall 19 through a body fastening portion 27. As shown in FIG. 2, the body fastening portion 27 may include a protrusion 271 disposed on an outer circumferential face of the mounting body 21, and a protrusion fastening groove 237 defined in the housing wall 19 and positioned in the wall through-hole S3, wherein the protrusion fastening groove 237 provides a space in which the protrusion 271 is accommodated.

The separator 4 is fixed to the mounting body 21. Thus, when the user opens the housing outlet 17 with the lower cover 18 and pulls the separator 4 to the housing outlet 17, the mounting body 21 and the first filter F1 may be drawn out of the housing 1 together with the separator 4.

The fan 5 is disposed in the second space S2 to flow the air in the first space S1 to the exhaust hole 153 through the first communicating openings 25, the second communicating openings 26, and the top face through-hole 213. Further, the separator 4 is a flow path formed in the first space S1 to guide the air flowed into the intake port 11 to the two communicating openings 25 and 26. The foreign matters such as dust contained in the air are separated from the air by a centrifugal force while flowing to the fan 5 along the flow path provided by the separator 4, and a specific structure thereof is as follows.

The separator 4 includes a chamber forming portion (or chamber forming wall) 41 for dividing the first space S1 into a first separated chamber 41*a* and a second separated chamber 41*b*, and a cyclone forming portion (or cyclone forming cylinders) 42 for supplying the air in the second separated chamber 41*b* to the fan 5. The cyclone forming portion 42 is for providing the centrifugal force to the foreign matters contained in the air by rotating the air flowing to the fan 5.

The chamber forming portion 41 is formed in a hollow cylindrical shape. One end of the chamber forming portion 41 may be fixed to the bottom face 23 of the mounting body, and the other end of the chamber forming portion 41 may include a separated chamber body 411 in contact with the lower cover 18, and a separated chamber wall 417 for separating the second separated chamber 41*b* formed in the separated chamber body into a separated space 418 and a storage space 419.

The separated chamber body 411 includes a plurality of through-holes 413 communicating the first separated chamber 41*a* and the separated space 418 with each other. Therefore, the air flowed into the first separated chamber 41*a* through the intake port 11 may be supplied to the separated space 418 through the through-hole 413.

An outlet 415 is defined in a bottom face of the separated chamber body 411 in contact with the lower cover 18. Accordingly, the foreign matters stored in the storage space 419 may be discharged to the outside of the housing 1 through the outlet 415 when the lower cover 18 opens the housing outlet 17.

As shown in FIG. 3, each cyclone forming portion 42 may have one end fixed to the bottom face 23 of the mounting body, and the other end including a flow path body 421 penetrating through the separated chamber wall 417 and in communication with the storage space 419, each discharge pipe 424 having one end connected to the mounting space 211 and the other end located inside the flow path body 421, each inlet 423 defined to penetrate a circumferential face of the flow path body 421, and each air flow forming portion 425 forming a spiral flow path between an outer circumferential face of the discharge pipe 424 and an inner circumferential face of the flow path body.

The first communicating openings 25 and the second communicating openings 26 are defined as communicating holes penetrating the bottom face 23 of the mounting body. Each discharge pipe 424 may be disposed as a pipe fixed to each of the communicating holes. Each flow path body 421 may be fixed to the bottom face 23 of the mounting body and having each pipe fixed to each communicating hole.

In one example, each foreign matter outlet 422 is defined at a free end of each flow path body 421 (a bottom face of the flow path body) positioned in the storage space 419. Thus, each flow path body 421 may be in communication with the storage space 419 through each foreign matter outlet 422. Each flow path body 421 may be disposed to decrease in diameter toward the free end thereof. This is to strongly maintain a strength of the air flow formed therein.

Each inlet 423 is located at a point higher than each air flow forming portion 425. Therefore, when the fan 5 is operated, the air flowing into the flow path body 421 through the inlet 423 flows to the discharge pipe 424 via the air flow forming portion 425. In this process, the air will flow while rotating inside the flow path body 421 (e.g., a cyclone flow). When the cyclone flow occurs in the flow path body 421, the foreign matters contained in the air will flow to an edge of the flow path (the circumferential face of the flow path body) by the centrifugal force, and then be discharged to the storage space 419 by gravity.

Each cyclone forming portion 42 having the above-described structure may include each first cyclone forming portion connected to each communicating hole of the first communicating openings 25, and each second cyclone forming portion connected to each communicating hole of the second communicating openings 26. The number of first cyclone forming portions may be equal to the number of communicating holes constituting the first communicating openings 25, and the number of second cyclone forming portions may be equal to the number of communicating holes constituting the second communicating openings 26.

As shown in FIG. 2, the fan 5 is disposed in the second space S2 of the housing to flow the air flowed into the first communicating openings 25 and the second communicating openings 26 to the exhaust hole 153. The fan 5 may include a casing 51 disposed in the second space S2, an impeller 57 rotatably disposed inside the casing, and a motor 54 fixed to the casing to rotate the impeller 57.

The casing 51 may be disposed in a hollow cylinder shape. Further, a casing intake hole 511 and a casing exhaust hole 513 are defined in the casing 51. It is preferable that the casing intake hole 511 is defined in one face of the casing 51 inserted into the mounting space 211, and the casing exhaust hole 513 directed toward the exhaust hole 153 is defined to penetrate one face of the casing 51.

The motor 54 may be fixed to a support 515 fixed inside the casing 51. In this case, the casing exhaust hole 513 may be defined as a support through-hole passing through the support 515. The impeller 57 is disposed to be positioned between the casing intake hole 511 and the casing exhaust hole 513, and a rotation shaft 541 of the motor penetrates through the support 515 and is connected to the impeller 57.

The motor 54 may be disposed to receive power through a power source disposed in the room, or may be disposed to receive the power through a battery 65 detachable from the housing 1. When the handle 6 is disposed to include a handle body 61 protruding in a direction farther away from the intake port on a rear face (a face opposite to the face on which the intake port is positioned) of the housing 1, the handle body 61 may include a battery housing 63 in which the battery 65 is detachably accommodated.

In one example, in order for filtration of the foreign matters, which is not removed through the separator 4, the present disclosure may further include filters F1 and F2. The filters further includes at least one of a first filter F1 and a second filter F2. FIG. 2 illustrates an example in which the filters includes both the first filter F1 and the second filter F2.

The first filter F1 may be located between the casing intake hole 511 and the mounting body bottom face 23 to filter the air, and the second filter F2 may be located between the casing exhaust hole 513 and the exhaust hole 153 to filter the air. The first filter F1 and the second filter F2 may be disposed to filter foreign matters of the same size, or may be disposed to filter foreign matters of different sizes. When the first filter F1 and the second filter F2 are disposed to filter the foreign matters of different sizes, it is preferable that the second filter F2 is disposed to filter foreign matters of a size smaller than a size of the foreign matters filtered by the first filter F1. This is to minimize an amount of fine dusts discharged to an indoor space.

Figure 4:
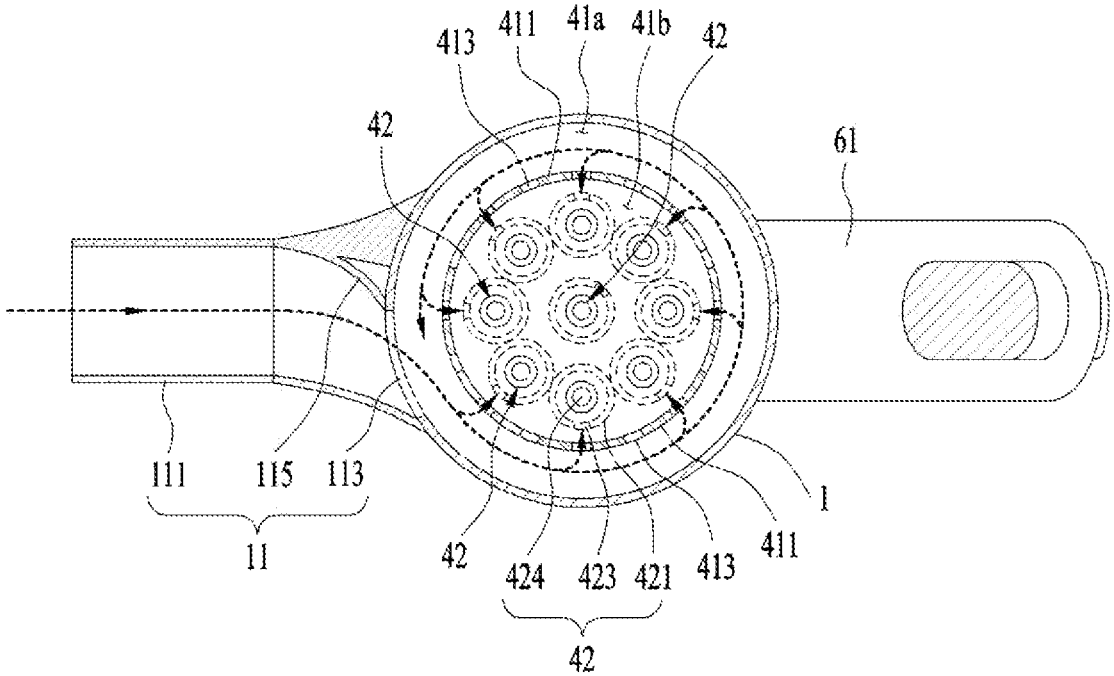

As shown in FIG. 4, when electric power is supplied to the motor 54 and the impeller 57 rotates, the air is flowed into the first separated chamber 41*a* through the intake pipe 111 and the intake hole 113. The intake pipe 111 includes a housing guide 115 that allows the air discharged from the intake hole 113 to inflow in a tangential direction of a circumferential face of the first separated chamber 41*a*. Therefore, the air flowed into the first separated chamber 41*a* will rotate along the circumferential face of the first separated chamber 41*a*.

When the air rotates inside the first separated chamber 41*a*, the foreign matters in the air flow to the circumferential face of the first separated chamber 41*a* by a centrifugal force, and then flows to the lower cover 18 disposed on the bottom face of the housing by gravity. Further, the air will flow through the through-hole 413 to the second separated chamber 41*b*.

The air flowed to the second separated chamber 41*b* will flow to the flow path body 421 through the inlet 423, and the air flowed into the flow path body 421 will flow cyclonically while passing through the air flow forming portion 425. When the cyclone flow occurs in the flow path body 421, the foreign matters contained in the air will flow to the circumferential face of the flow path body 421 by a centrifugal force and then be discharged to the storage space 419 by gravity. Further, the air will be discharged out of the housing 1 through the discharge tube 424, the first communicating openings 25, the second communicating openings 26, the top face through-hole 213, the casing intake hole 511, the casing exhaust hole 513, and the exhaust hole 153. The foreign matters stored in the storage space 419 and the first separated chamber 41*a* are discharged to the outside of the housing 1 when the lower cover 18 opens the housing outlet 17.

Further, in the cleaner 100 having the above-described structure, a volume of the first filter F1 is limited by a volume of the mounting space 211, so that a filtration capacity of the first filter F1 is limited by the volume of the mounting space 211. In addition, in the cleaner 100 having the above-described structure, among filter faces provided by the first filter F1, only a filter face (a filter face in which the first communicating openings and the second communicating openings are defined) facing the bottom face 23 of the mounting body functions to filter the foreign matters. That is, the filter faces of the first filter F1 which do not face the bottom face 23 of the mounting body do not serve to separate the foreign matters from the air. This may cause a problem that the first filter F1 does not perform the function of filtering the air when a lot of foreign matters are accumulated on the filter face facing the bottom face 23 of the mounting body even when other filter faces of the first filter F1 are in a state of being able to filter the foreign matters.

Figure 5:
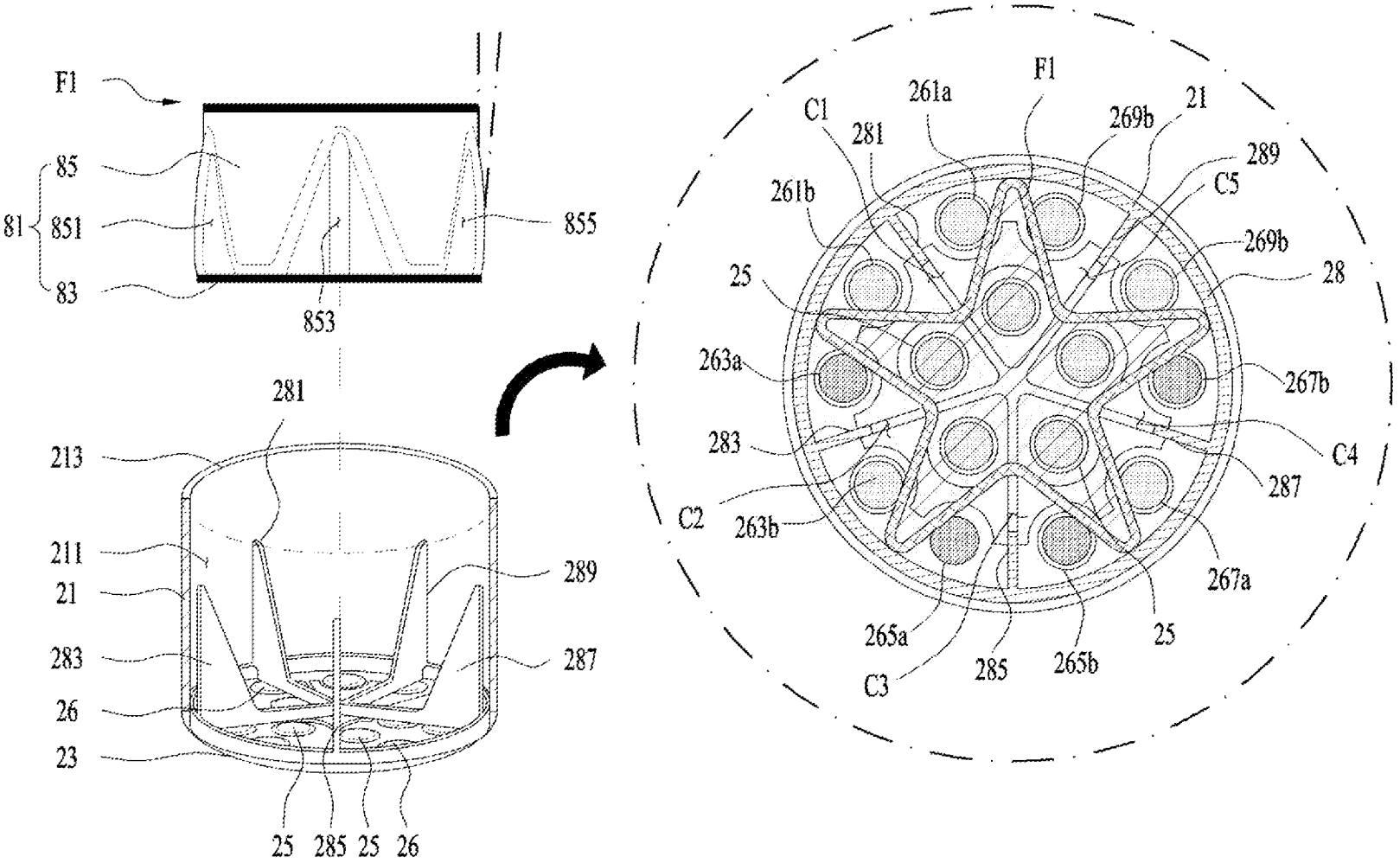
FIG. 5 illustrates an example of a mounting portion.

FIG. 5 illustrates an example of the first filter F1 in which all filter faces thereof are able to filter the air, thereby maximizing the filtration capacity. The first filter F1 may include a filter body 81 having a cup shape (a cylindrical shape with open top face) located in the mounting space 211, a first filter face 83 disposed on a face facing the bottom face of a space provided by the filter body 81 to filter the air flowed into the first communicating openings 25, and a second filter face 85 disposed on the filter body 81 to filter the air flowed into the second communicating openings 26.

Figure 6:
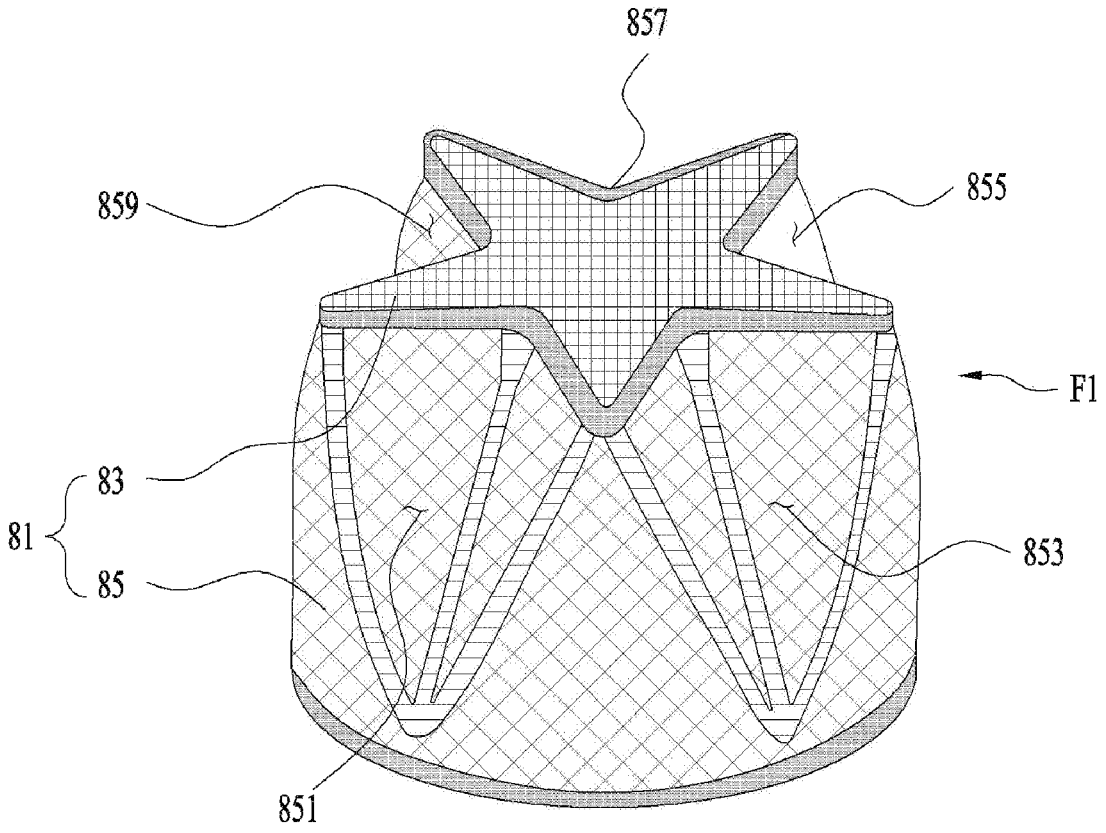
FIGS. 6, 7, 8, 9, and 10 illustrate different embodiments of filters.

As shown in FIG. 6, the second filter face 85 is disposed to divide the mounting space 211 into a space in which the first communicating openings 25 is defined (a space in which the first region is located) and a space in which the second communicating openings 26 is defined (a space in which the second region is located). That is, the second filter face 85 includes a plurality of chamber forming portions (or chamber forming walls) 851, 853, 855, 857, and 859 arranged on a side face of the filter body 81, and respectively forming a plurality of filtering chambers of the number equal to the number of communicating holes constituting the first communicating openings 25 and the second communicating openings 26 in the mounting space 211.

Figure 7:
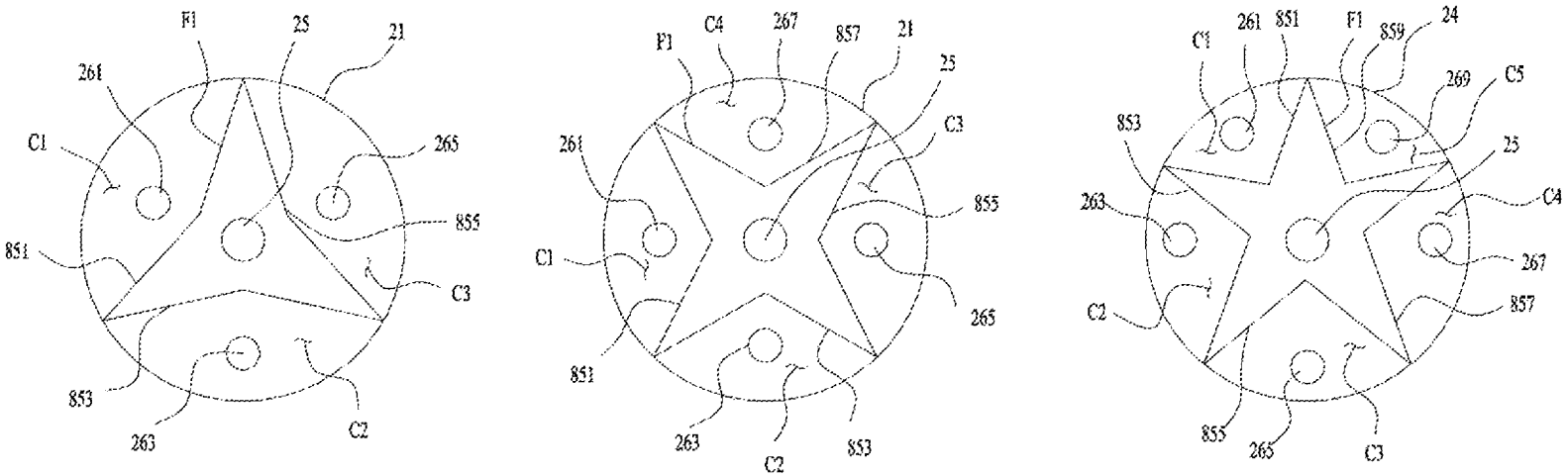

As shown in portion A of FIG. 7, when the second communicating openings 26 is defined as a first communicating hole 261, a second communicating hole 263, and a third communicating hole 265, the chamber forming portions may be arranged as a first chamber forming portion 851, a second chamber forming portion 853, and a third chamber forming portion 855. The first chamber forming portion 851, the second chamber forming portion 853, and the third chamber forming portion 855 may be formed in shapes bent from the second filter face 85 (the side face of the filter body) toward a center of the filter body 81.

The first chamber forming portion 851 is disposed to form a first filtering chamber C1 in communication only with the first communicating hole 261 in the mounting space 211, the second chamber forming portion 853 is disposed to form a second filtering chamber C2 in communication only with the second communicating hole 263 in the mounting space 211, and the third chamber forming portion 855 is disposed to form a third filtering chamber C3 in communication only with the third communicating hole 265 in the mounting space 211. It is preferable that the chamber forming portions 851, 853, and 855 are arranged such that the first filtering chamber C1, the second filtering chamber C2, and the third filtering chamber C3 are independent of each other.

The air flowed into the first communicating openings 25 passes through the first filter face 83 and then flows to the fan 5. Further, the air flowed into the first communicating hole 261 of the second communicating openings passes through the first filtering chamber C1 and then flows to the fan. Further, the air flowed into the second communicating hole 263 passes through the second filtering chamber C2 and then flows to the fan. Further, the air flowed into the third communicating hole 265 passes through the third filtering chamber C3 and then flows to the fan. Therefore, the first filter F1 having the above-described structure has an effect that the first filter face 83 and the second filter face 85 all filter the foreign matters.

When the second filter face 85 is disposed to be in close contact with an inner circumferential face of the mounting body 21 (when no chamber forming portions are arranged on the second filter face), the air flowed into the first communicating openings 25 and the second communicating openings 26 may pass through only the first filter face 83 and then flow to the fan 5. In this case, the second filter face 85 may not be able to perform a function of filtering the air, but the above-described first filter F1 may prevent such a problem. In addition, the first filter F1 described above may maximize a surface area of the second filter face 85, so that a filtration capacity of the filter located in the mounting space 211 with a limited volume may be maximized.

Portion B of FIG. 7 illustrates a case in which the second communicating openings 26 is defined as the first communicating hole 261, the second communicating hole 263, the third communicating hole 265, and a fourth communicating hole 267. In this case, the chamber forming portions should be arranged as the first chamber forming portion 851, the second chamber forming portion 853, the third chamber forming portion 855, and a fourth chamber forming portion 857. The fourth chamber forming portion 857 forms a fourth filtering chamber C4 in communication only with the fourth communicating hole 267 inside the mounting space by bending a surface of the second filter 85 toward the center of the filter body 81. The fourth filtering chamber C4 is preferably disposed as an independent space separate from the first filtering chamber C1, the second filtering chamber C2, and the third filtering chamber C3.

Portion C of FIG. 7 illustrates a case in which the second communicating openings 26 is defined as the first communicating hole 261, the second communicating hole 263, the third communicating hole 265, the fourth communicating hole 267, and a fifth communicating hole 269. In this case, the chamber forming portions should be arranged as the first chamber forming portion 851, the second chamber forming portion 853, the third chamber forming portion 855, the fourth chamber forming portion 857, and a fifth chamber forming portion 859.

The fifth chamber forming portion 859 forms a fifth filtering chamber C5 in communication only with the fifth communicating hole 269 inside the mounting space by bending the surface of the second filter 85 toward the center of the filter body 81. The fifth filtering chamber C5 is preferably disposed as an independent space separate from the first filtering chamber C1, the second filtering chamber C2, the third filtering chamber C3, and the fourth filtering chamber C4.

Figure 8:
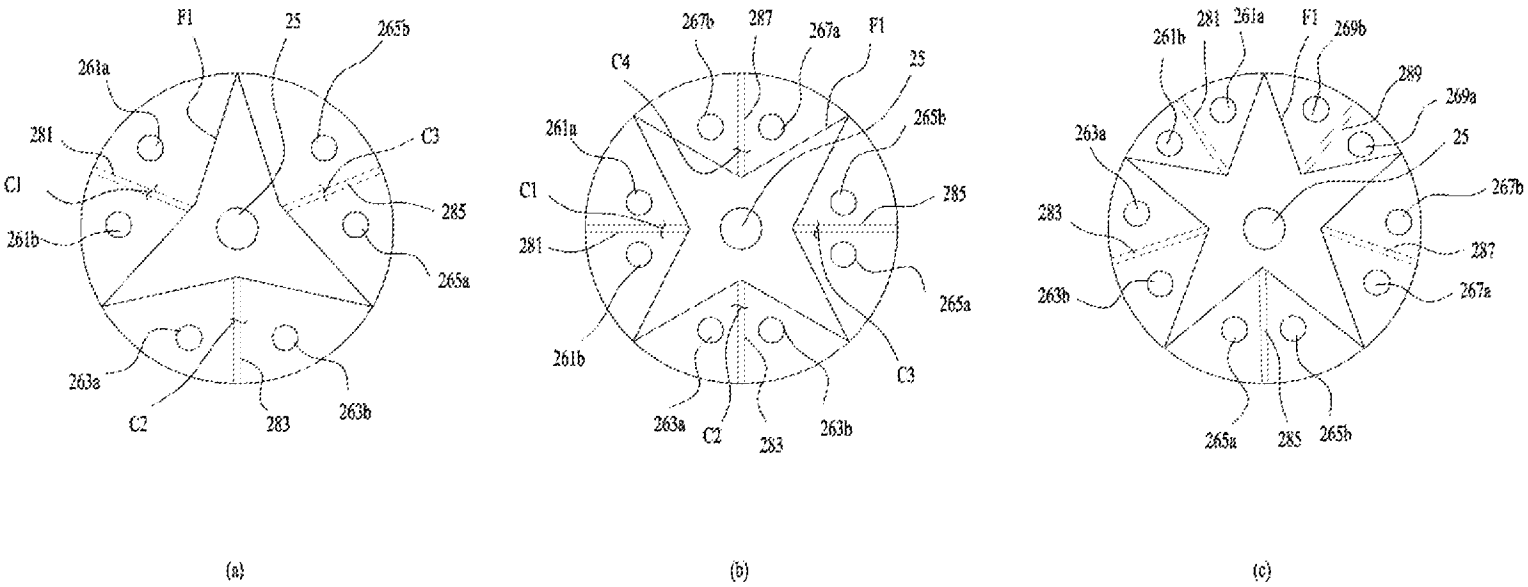

FIG. 8 illustrates an example in which each of the communicating holes constituting the second communicating openings 26 includes two holes. That is, portion A of FIG. 8 illustrates a case in which each of the first communicating hole 261, the second communicating hole 263, and the third communicating hole 265 of the second communicating openings includes two holes. Portion B of FIG. 8 illustrates a case in which each of the first communicating hole 261, the second communicating hole 263, the third communicating hole 265, and the fourth communicating hole 267 includes two holes. Further, portion C of FIG. 8 illustrates a case in which each of the first communicating hole 261, the second communicating hole 263, the third communicating hole 265, the fourth communicating hole 267, and the fifth communicating hole 269 includes two holes.

In the embodiment of FIG. 8, the first communicating hole 261 is defined as a first chamber first hole 261*a* and a first chamber second hole 261*b*. The second communicating hole 263 is defined as a second chamber first hole 263*a* and a second chamber second hole 263*b*. The third communicating hole 265 is defined as a third chamber first hole 265*a* and a third chamber second hole 265*b*. The fourth communicating hole 267 is defined as a fourth chamber first hole 267*a* and a fourth chamber second hole 267*b*. Further, the fifth communicating hole 269 is defined as a fifth chamber first hole 269*a* and a fifth chamber second hole 269*b*. The mounting body 21 may further include guides 281, 283, 285, 287, and 289, each of which separates two chamber holes defined in one filtering chamber from each other.

Portion A of FIG. 8 illustrates a case in which the guide includes a first guide 281 that divides the first filtering chamber C1 into two spaces to separate the first chamber first hole 261*a* and the first chamber second hole 261*b* from each other, a second guide 283 that divides the second filtering chamber C2 into two spaces to separate the second chamber first hole 263*a* and the second chamber second hole 263*b* from each other, and a third guide 285 that divides the third filtering chamber C3 into two spaces to separate the third chamber first hole 265*a* and the third chamber second hole 265*b* from each other.

Portion B of FIG. 8 illustrates an embodiment in which the guide further includes a fourth guide 287 that divides the fourth filtering chamber C4 into two spaces to separate the fourth chamber first hole 267*a* and the fourth chamber second hole 267*b* from each other, and portion C of FIG. 8 illustrates an embodiment in which the guide further includes a fifth guide 289 that divides the fifth filtering chamber C5 into two spaces to separate the fifth chamber first hole 269*a* and the fifth chamber second hole 269*b* from each other.

The embodiments of FIGS. 7 and 8 illustrate examples in which the first communicating openings 25 is defined as one communicating hole. However, the first communicating openings 25 may also be defined as a plurality of communicating holes.

The first filter F1 illustrated in FIGS. 7 and 8 have shapes in which each of the chamber forming portions 851, 853, 855, 857, and 859 protrude sharply toward the center of the filter body 81. However, each chamber forming portion is not necessarily formed in a sharply protruding shape.

Figure 9:
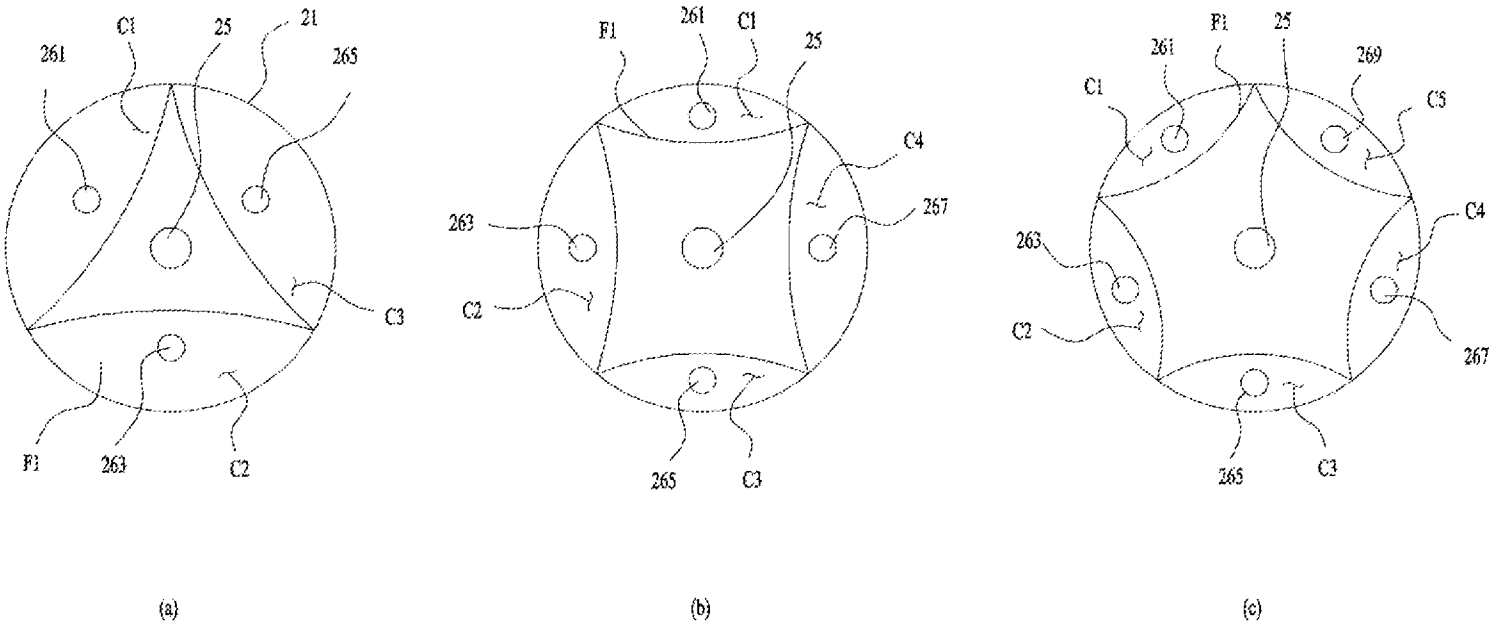

FIG. 9 illustrates another embodiment of the first filter F1. Portions A to C of FIG. 9 illustrate an example of the first filter F1 in which each of the chamber forming portions 851, 853, 855, 857, and 859 is disposed as a face concavely curved toward the center of the filter body 81.

Figure 10:
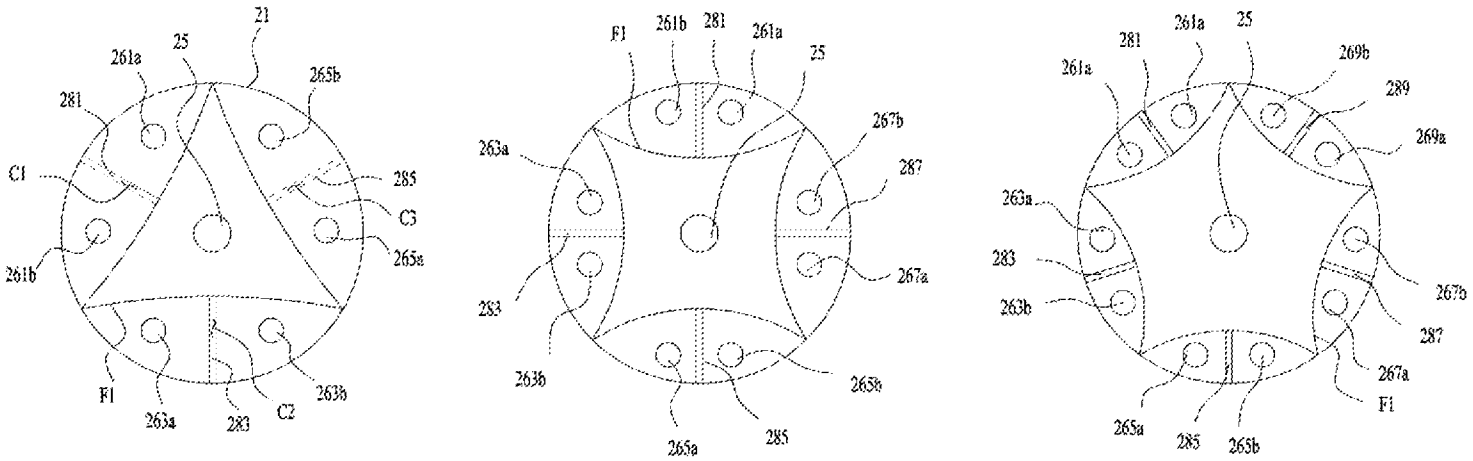

FIG. 10 illustrates an example in which each of the chamber forming portions 851, 853, 855, 857, and 859 is disposed as a face concavely curved toward the center of the filter body 81, the mounting body 21 is formed to include the guides 281, 283, 285, 287, and 289 that respectively divide the filtering chambers C1 to C5 respectively formed by the chamber forming portions 851, 853, 855, 857, and 859 into the two spaces, and each of the communicating holes 261, 263, 265, 267, and 269 constituting the second communicating openings is defined to include two chamber holes separated from each other by each guide.

Figure 11:
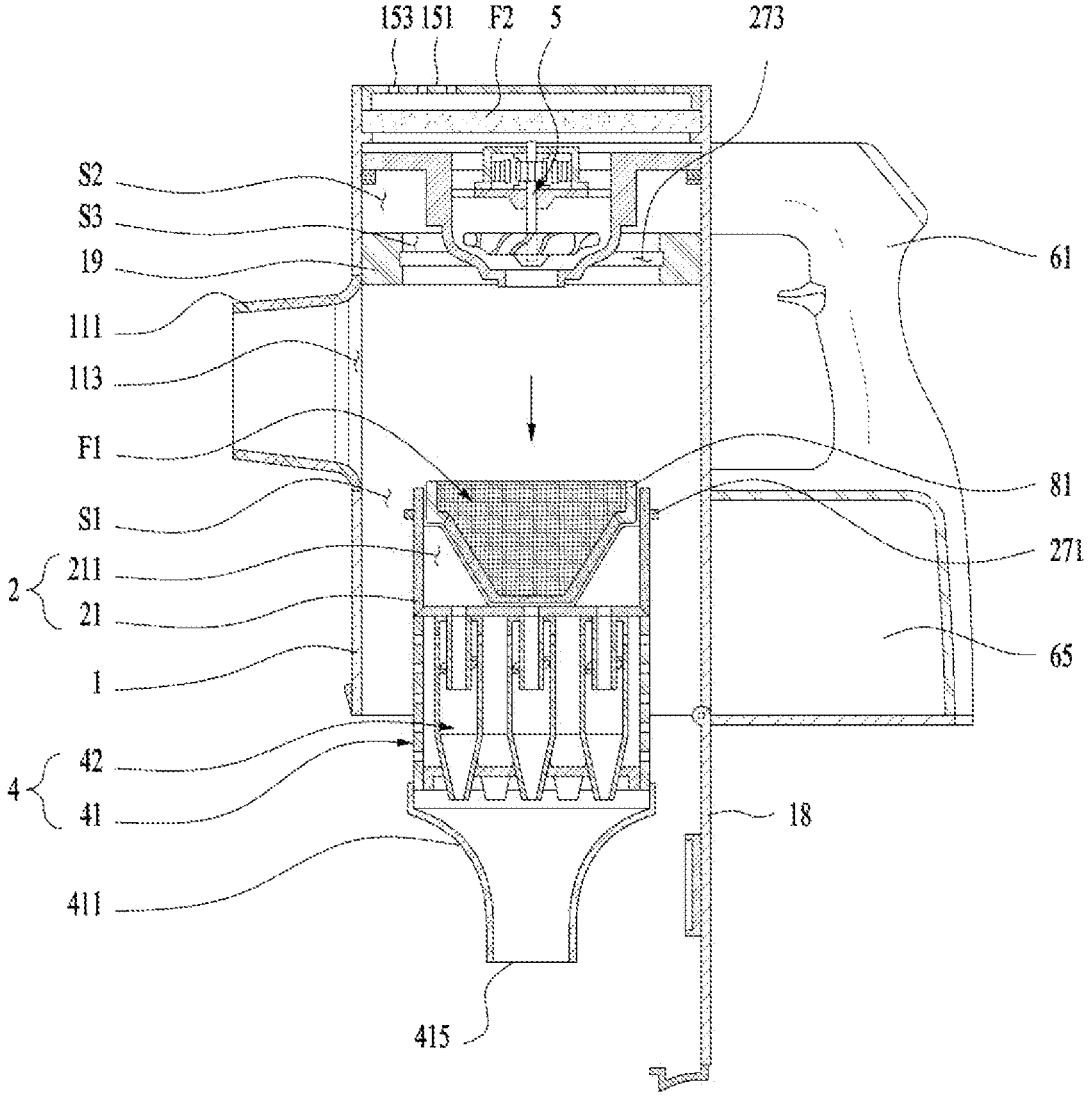
FIG. 11 illustrates an example of a process of withdrawing a mounting portion, a first filter, and a separator from a housing.

In the cleaner having the above-described structure, when the user separates the separator 4 from the housing 1, the first filter F1 may be separated from the housing 1 together with the separator 4. That is, as shown in FIG. 11, when the user opens the housing outlet 17 with the lower cover 18 and then pulls the separator 4 toward the housing outlet 17, the mounting body 21 and the first filter F1 seated in the mounting body 21 may be drawn out of the housing 1 together with the separator 4. This is because the separator 4 may be fixed to the mounting body 21, and the mounting body 21 is detachably coupled to the protrusion fastening groove 273 defined in the housing wall 19 through the protrusion 271. When the mounting body 21 and the first filter F1 are withdrawn from the housing 1, the user may detach the first filter F1 from the mounting body 21. Therefore, the cleaner having the above-described structure has an effect of facilitating separation and cleaning of the first filter F1.

A aspect of the present application is to provide a cleaner capable of maximizing a filtration capacity of a filter installed in a mounting space having a limited volume. Further, another aspect of the present application is to provide a cleaner in which a filter is easy to be cleaned.

The present application provides a cleaner including a housing divided into a first space and a second space, a mounting portion including a mounting body disposed in a wall through-hole connecting the first space and the second space with each other, first communicating openings penetrating a bottom face of the mounting body and in communication with the mounting space, wherein the first communicating openings is defined in a first region of the bottom face, and second communicating openings penetrating the bottom face and in communication with the mounting space, wherein the second communicating openings is defined in a second region separated from the first region, a separator disposed in the first space to form a flow path for guiding air flowed into the housing to the plurality of communicating openings, wherein the separator separates foreign matters from the air using a centrifugal force, a fan disposed in the second space to flow the air flowed into the plurality of communicating openings to outside of the housing, a cup-shaped filter body located in the mounting space, a first filter face disposed on a face facing the bottom face in a space provided by the filter body to filter the air flowed into the first communicating openings, and a second filter face disposed on the filter body to divide the mounting space into a space including the first region located therein and a space including the second region located therein, wherein the second filter face filters the air flowed into the second communicating openings.

The second communicating openings may include a first communicating hole, a second communicating hole, and a third communicating hole, wherein the second filter face may include a first chamber forming portion bending the second filter face toward a center of the filter body to form a first filtering chamber in communication only with the first communicating hole in the mounting space, a second chamber forming portion bending the second filter face toward the center of the filter body to form a second filtering chamber in communication only with the second communicating hole in the mounting space, and a third chamber forming portion for bending the second filter face toward the center of the filter body to form a third filtering chamber in communication only with the third communicating hole in the mounting space.

The cleaner may further include a first guide dividing the first filtering chamber into two spaces, a second guide dividing the second filtering chamber into two spaces, and a third guide dividing the third filtering chamber into two spaces, wherein the first communicating hole may include two holes respectively defined in the spaces separated from each other by the first guide, wherein the second communicating hole may include two holes respectively defined in the spaces separated from each other by the second guide, and wherein the third communicating hole may include two holes respectively defined in the spaces separated from each other by the third guide.

The present application provides a cleaner including a hollow cylindrical housing, a housing wall dividing an internal space of the housing into a first space and a second space, a wall through-hole defined to pass through the housing wall, a mounting portion including a mounting body having a top face and a mounting space defined therein in communication with the second space, wherein the mounting body is fixed into the wall through-hole, first communicating openings penetrating a bottom face of the mounting body and in communication with the mounting space, wherein the first communicating openings is defined in a first region of the bottom face, and second communicating openings penetrating the bottom face and in communication with the mounting space, wherein the second communicating openings is defined in a second region separated from the first region, an intake port communicating the first space with an exterior of the housing, an exhaust hole communicating the second space with the exterior of the housing, a separator disposed in the first space to form a flow path for guiding air flowed into the intake port to the plurality of communicating openings, wherein the separator separates foreign matters from the air using a centrifugal force, a fan disposed in the second space to flow the air flowed into the plurality of communicating openings to the exhaust hole, and filters disposed in the mounting portion to filter the air flowing to the fan.

The filters may include a cup-shaped filter body located in the mounting space, a first filter face disposed on a face facing the bottom face in a space provided by the filter body to filter the air flowed into the first communicating openings, and a second filter face disposed on the filter body to divide the mounting space into a space including the first region located therein and a space including the second region located therein, wherein the second filter face filters the air flowed into the second communicating openings. The first region may be defined as a region including a center of the bottom face, and wherein the second region may be defined as a ring-shaped region surrounding the first region.

The second communicating openings may include at least two communicating holes, and wherein the second filter face may include chamber forming portions arranged on a side face of the filter body to respectively form filtering chambers of the number equal to the number of communicating holes in the mounting space.

The filtering chambers are arranged to respectively define spaces independent of each other. Each of the chamber forming portions has the second filter face having a shape of being bent toward a center of the filter body. The cleaner may further include each guide being disposed in the mounting portion to divide each filtering chamber into two spaces, wherein each of the communicating holes constituting the second communicating openings may include two holes separated from each other by each guide.

The second communicating openings may include a first communicating hole, a second communicating hole, and a third communicating hole, wherein the second filter face may include a first chamber forming portion bending the second filter face toward a center of the filter body to form a first filtering chamber in communication only with the first communicating hole in the mounting space, a second chamber forming portion bending the second filter face toward the center of the filter body to form a second filtering chamber in communication only with the second communicating hole in the mounting space, and a third chamber forming portion for bending the second filter face toward the center of the filter body to form a third filtering chamber in communication only with the third communicating hole in the mounting space.

The cleaner may further include a first guide dividing the first filtering chamber into two spaces, a second guide dividing the second filtering chamber into two spaces, and a third guide dividing the third filtering chamber into two spaces, wherein the first communicating hole may include two holes separated from each other by the first guide, wherein the second communicating hole may include two holes separated from each other by the second guide, and wherein the third communicating hole may include two holes separated from each other by the third guide.

The second communicating openings may further include a fourth communicating hole, and wherein the second filter face may further include a fourth chamber forming portion bending the second filter face toward the center of the filter body to form a fourth filtering chamber in communication only with the fourth communicating hole in the mounting space. The fourth filtering chamber may be disposed to define a space independent of the first filtering chamber, the second filtering chamber, and the third filtering chamber.

The cleaner may further include a first guide dividing the first filtering chamber into two spaces, a second guide dividing the second filtering chamber into two spaces, a third guide dividing the third filtering chamber into two spaces, and a fourth guide dividing the fourth filtering chamber into two spaces, wherein the first communicating hole may include two holes separated from each other by the first guide, wherein the second communicating hole may include two holes separated from each other by the second guide, wherein the third communicating hole may include two holes separated from each other by the third guide, and wherein the fourth communicating hole may include two holes separated from each other by the fourth guide.

The second communicating openings further includes a fifth communicating hole, and the second filter face may further include a fifth chamber forming portion bending the second filter face toward the center of the filter body to form a fifth filtering chamber in communication only with the fifth communicating hole in the mounting space. The fifth filtering chamber may be disposed to define a space independent of the first filtering chamber, the second filtering chamber, the third filtering chamber, and the fourth filtering chamber.

The cleaner may further include a first guide dividing the first filtering chamber into two spaces, a second guide dividing the second filtering chamber into two spaces, a third guide dividing the third filtering chamber into two spaces, a fourth guide dividing the fourth filtering chamber into two spaces, and a fifth guide dividing the fifth filtering chamber into two spaces, wherein the first communicating hole may include two holes respectively defined in the spaces separated from each other by the first guide, wherein the second communicating hole may include two holes separated from each other by the second guide, wherein the third communicating hole may include two holes separated from each other by the third guide, wherein the fourth communicating hole may include two holes separated from each other by the fourth guide, and wherein the fifth communicating hole may include two holes separated from each other by the fifth guide.

The present application provides a cleaner including a hollow cylindrical housing, a housing wall dividing an internal space of the housing into a first space and a second space, a wall through-hole defined to pass through the housing wall, a mounting portion including a mounting body having a mounting space defined therein and detachably fixed to the wall through-hole, and communicating openings disposed to penetrate the mounting body, an intake port communicating the first space with an exterior of the housing, an exhaust hole communicating the second space with the exterior of the housing, a separator disposed in the first space to form a flow path for guiding air flowed into the intake port to the communicating openings, wherein the separator separates foreign matters from the air using a centrifugal force, a fan disposed in the second space to flow the air flowed into the plurality of communicating openings to the exhaust hole, a fan disposed in the second space to flow the air flowed into the communicating openings to the exhaust hole, and filters disposed in the mounting space to filter the air flowing to the fan.

The cleaner may further include a body fastening portion for detachably fixing the mounting body to the housing wall. The body fastening portion may include a protrusion disposed on an outer circumferential face of the mounting body, and a protrusion fastening groove defined in the housing wall and positioned in the wall through-hole, wherein the protrusion fastening groove provides a space in which the protrusion is accommodated.

In one example, a cleaner comprises: a hollow housing; a wall dividing an internal space of the housing into a first space and a second space; a through-hole defined to pass through the wall; a mount including: a mounting body having a top face and a mounting space defined therein in communication with the second space, wherein the mounting body is coupled to the through-hole; at least one first opening penetrating a bottom face of the mounting body and in communication with the mounting space, wherein the first opening is defined in a first region of the bottom face; and at least one second opening penetrating the bottom face and in communication with the mounting space, wherein the second opening is defined in a second region of the bottom face that is separated from the first region; an intake port, the first space communicating with an exterior of the housing via the intake port; an exhaust hole, the second space communicating with the exterior of the housing via the exhaust hole; a separator positioned in the first space to form a flow path to guide air flowing from the intake port to the first and second openings, wherein the separator removes material from the air using centrifugal force; a fan positioned in the second space to move air from the first and second openings to the exhaust hole; and a filter positioned in the mount to filter air flowing to the fan, wherein the filter includes: a cup-shaped filter body located in the mounting space; a first filter face positioned to face the bottom face of the mounting body to filter air flowing through the first opening; and a second filter face positioned on the filter body to divide the mounting space into a first space adjacent to the first region and a second space adjacent to the second region, wherein the second filter face filters air flowing through the second opening. The housing may have a cylindrical form.

The first region may include a center of the bottom face of the mounting body, and the second region may be defined as a ring-shaped region surrounding the first region. The second opening may include at least two communicating holes, and the second filter face may include chamber forming walls provided on a side face of the filter body to form, respectively, filtering chambers, a quantity of the filtering chambers formed by the chamber forming walls corresponding to a quantity of communicating holes in the mounting space.

The filtering chambers may be provided to define respective spaces that are independent of each other. Each of the chamber forming walls may be shaped to be bent toward a center of the filter body.

The cleaner may comprise one or more guides positioned in the mount to divide each of the filtering chambers into at least two spaces, wherein pairs of the communicating holes included in the second opening are separated from each other by one of the guides.

The second opening may include a first communicating hole, a second communicating hole, and a third communicating hole, and the second filter face may include: a first chamber forming wall that is bent toward a center of the filter body to form a first filtering chamber in communication with the first communicating hole in the mounting space and not in communication with the second and third communicating holes; a second chamber forming wall that is bent toward the center of the filter body to form a second filtering chamber in communication with the second communicating hole in the mounting space and not in communication with the first and third communicating holes; and a third chamber forming wall that is bent toward the center of the filter body to form a third filtering chamber in communication with the third communicating hole in the mounting space and not in communication with the first and second communicating holes.

The cleaner may further comprise: a first guide positioned to divide the first filtering chamber into at least two spaces; a second guide positioned to divide the second filtering chamber into at least two spaces; and a third guide positioned to divide the third filtering chamber into at least two spaces, wherein the first communicating hole includes at least two holes provided respectively in the spaces defined in the first filtering chamber by the first guide, wherein the second communicating hole includes at least two holes provided respectively in the spaces defined in the second filtering chamber by the second guide, and wherein the third communicating hole includes at least two holes provided respectively in the spaces separated defined in the third filtering chamber by the third guide.

The second opening may further include a fourth communicating hole, and the second filter face may further include a fourth chamber forming wall that is bent toward the center of the filter body to form a fourth filtering chamber in communication with the fourth communicating hole in the mounting space and not in communication with the first, second, and third communicating holes. The fourth filtering chamber may be positioned independent of the first filtering chamber, the second filtering chamber, and the third filtering chamber.

The cleaner may further comprise: a first guide positioned to divide the first filtering chamber into at least two spaces; a second guide positioned to divide the second filtering chamber into at least two spaces; a third guide positioned to divide the third filtering chamber into at least two spaces; and a fourth guide positioned to divide the fourth filtering chamber into at least two spaces, wherein the first communicating hole includes at least two holes separated from each other by the first guide, the second communicating hole includes at least two holes separated from each other by the second guide, the third communicating hole includes at least two holes separated from each other by the third guide, and the fourth communicating hole includes at least two holes separated from each other by the fourth guide.

The second opening may further include a fifth communicating hole, wherein the second filter face further includes a fifth chamber forming wall bent toward the center of the filter body to form a fifth filtering chamber in communication with the fifth communicating hole in the mounting space and not in communication with the first, second, third, and fourth communicating holes.

The cleaner may further comprise: a first guide positioned to divide the first filtering chamber into at least two spaces; a second guide positioned to divide the second filtering chamber into at least two spaces; a third guide positioned to divide the third filtering chamber into at least two spaces; a fourth guide positioned to divide the fourth filtering chamber into at least two spaces; and a fifth guide positioned to divide the fifth filtering chamber into at least two spaces, wherein the first communicating hole includes at least two holes separated from each other by the first guide, the second communicating hole includes at least two holes separated from each other by the second guide, the third communicating hole includes at least two holes separated from each other by the third guide, the fourth communicating hole includes at least two holes separated from each other by the fourth guide, and the fifth communicating hole includes at least two holes separated from each other by the fifth guide.

In another example, a cleaner may comprise: a housing having an intake port and an exhaust port; a fan provided in the housing to generate an air flow into the housing through the intake port and out of the housing via the exhaust port; a separator provided in the housing and including a plurality of flow path bodies that extend in an axial direction of the housing to generate a plurality of cyclones to remove material from air flowing from the intake port, the plurality of flow path bodies including first axial ends and second axial ends that are positioned further from the fan than the first axial ends; a mount provided in the housing between fan and the separator and including: a mounting body having a top face and a mounting space defined therein; a plurality of openings in a bottom face of the mounting body and positioned to correspond to the first axial ends of the flow path bodies, the plurality of openings including a first opening in a first region of the bottom face and at least one second opening in a second region of the bottom face that is separated from the first region; and a filter positioned in the mount to filter air flowing to the fan and including: a filter body located in the mounting space; a first filter face positioned to face the bottom face of the mounting body to filter air flowing through the first opening; and a second filter face positioned on the filter body to divide the mounting space into a first space adjacent to the first region and a second space adjacent to the second region, wherein the second filter face filters air flowing through the second opening.

The first region includes a center of the bottom face of the mounting body, and the second region includes a ring-shaped region surrounding the first region. The second opening includes at least two communicating holes, and the second filter face includes chamber forming walls provided on a side face of the filter body to form, respectively, filtering chambers, a quantity of the filtering chambers formed by the chamber forming walls corresponding to a quantity of communicating holes in the mounting space.

The filtering chambers are provided to define respective spaces that are independent of each other. Each of the chamber forming walls is shaped to be bent toward a center of the filter body. The cleaner may further comprise one or more guides positioned in the mount to divide each of the filtering chambers into at least two spaces, wherein pairs of the communicating holes included in the second opening are separated from each other by one of the guides.

Aspects of the present application may provide the cleaner that may maximize the filtration capacity of the filter installed in the mounting space having the limited volume. Further, aspects of the present application may provide the cleaner in which the filter is easy to be cleaned.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner comprising:

a hollow housing;

a wall dividing an internal space of the housing into a first space and a second space;

a through-hole defined to pass through the wall;

a mount including:

a mounting body having a top face and a mounting space defined therein in communication with the second space, wherein the mounting body is coupled to the through-hole;

at least one first opening penetrating a bottom face of the mounting body and in communication with the mounting space, wherein the first opening is defined in a first region of the bottom face that is a region including a center of the bottom face of the mounting body; and at least one second opening penetrating the bottom face and in communication with the mounting space, wherein the second opening is defined in a second region of the bottom face that is separated from the first region and defined as a ring-shaped region surrounding the first region;

an intake port, the first space communicating with an exterior of the housing via the intake port;

an exhaust hole, the second space communicating with the exterior of the housing via the exhaust hole;

a separator positioned in the first space to form a flow path to guide air flowing from the intake port to the first and second openings, wherein the separator removes material from the air using centrifugal force;

a fan positioned in the second space to move air from the first and second openings to the exhaust hole; and a filter positioned in the mount to filter air flowing to the fan, wherein the filter includes:

a cup-shaped filter body located in the mounting space;

a first filter face positioned to face the bottom face of the mounting body to filter air flowing through the first opening; and a second filter face positioned on the filter body to divide the mounting space into a first space adjacent to the first region and a second space adjacent to the second region, wherein the second filter face filters air flowing through the second opening, wherein the second opening includes at least two communicating holes, and wherein the second filter face includes chamber forming walls provided on a side face of the filter body to form, respectively, filtering chambers, a quantity of the filtering chambers formed by the chamber forming walls being equal to a quantity of communicating holes in the mounting space.

2. The cleaner of claim 1, wherein the filtering chambers are provided to define respective spaces that are independent of each other.

3. The cleaner of claim 1, wherein each of the chamber forming walls is shaped to be bent toward a center of the filter body.

4. The cleaner of claim 3, further comprising one or more guides positioned in the mount to divide each of the filtering chambers into at least two spaces, wherein pairs of the communicating holes included in the second opening are separated from each other by one of the guides.

5. The cleaner of claim 1, wherein the second opening includes a first communicating hole, a second communicating hole, and a third communicating hole, wherein the second filter face includes:

a first chamber forming wall that is bent toward a center of the filter body to form a first filtering chamber in communication with the first communicating hole in the mounting space and not in communication with the second and third communicating holes;

a second chamber forming wall that is bent toward the center of the filter body to form a second filtering chamber in communication with the second communicating hole in the mounting space and not in communication with the first and third communicating holes; and a third chamber forming wall that is bent toward the center of the filter body to form a third filtering chamber in communication with the third communicating hole in the mounting space and not in communication with the first and second communicating holes.

6. The cleaner of claim 5, further comprising:

a first guide positioned to divide the first filtering chamber into at least two spaces;

a second guide positioned to divide the second filtering chamber into at least two spaces; and a third guide positioned to divide the third filtering chamber into at least two spaces, wherein the first communicating hole includes at least two holes provided respectively in the spaces defined in the first filtering chamber by the first guide, wherein the second communicating hole includes at least two holes provided respectively in the spaces defined in the second filtering chamber by the second guide, and wherein the third communicating hole includes at least two holes provided respectively in the spaces separated defined in the third filtering chamber by the third guide.

7. The cleaner of claim 5, wherein the second opening further includes a fourth communicating hole, and wherein the second filter face further includes a fourth chamber forming wall that is bent toward the center of the filter body to form a fourth filtering chamber in communication with the fourth communicating hole in the mounting space and not in communication with the first, second, and third communicating holes.

8. The cleaner of claim 7, wherein the fourth filtering chamber is positioned independent of the first filtering chamber, the second filtering chamber, and the third filtering chamber.

9. The cleaner of claim 7, further comprising:

a first guide positioned to divide the first filtering chamber into at least two spaces;

a second guide positioned to divide the second filtering chamber into at least two spaces;

a third guide positioned to divide the third filtering chamber into at least two spaces; and a fourth guide positioned to divide the fourth filtering chamber into at least two spaces, wherein the first communicating hole includes at least two holes separated from each other by the first guide, wherein the second communicating hole includes at least two holes separated from each other by the second guide, wherein the third communicating hole includes at least two holes separated from each other by the third guide, and wherein the fourth communicating hole includes at least two holes separated from each other by the fourth guide.

10. The cleaner of claim 7, wherein the second opening further includes a fifth communicating hole, wherein the second filter face further includes a fifth chamber forming wall bent toward the center of the filter body to form a fifth filtering chamber in communication with the fifth communicating hole in the mounting space and not in communication with the first, second, third, and fourth communicating holes.

11. The cleaner of claim 10, further comprising:

a first guide positioned to divide the first filtering chamber into at least two spaces;

a second guide positioned to divide the second filtering chamber into at least two spaces;

a third guide positioned to divide the third filtering chamber into at least two spaces;

a fourth guide positioned to divide the fourth filtering chamber into at least two spaces; and a fifth guide positioned to divide the fifth filtering chamber into at least two spaces, wherein the first communicating hole includes at least two holes separated from each other by the first guide, wherein the second communicating hole includes at least two holes separated from each other by the second guide, wherein the third communicating hole includes at least two holes separated from each other by the third guide, wherein the fourth communicating hole includes at least two holes separated from each other by the fourth guide, and wherein the fifth communicating hole includes at least two holes separated from each other by the fifth guide.

12. The cleaner of claim 1, wherein the housing has a cylindrical form.

13. A cleaner comprising:

a housing having an intake port and an exhaust port;

a fan provided in the housing to generate an air flow into the housing through the intake port and out of the housing via the exhaust port;

a separator provided in the housing and including a plurality of flow path bodies that extend in an axial direction of the housing to generate a plurality of cyclones to remove material from air flowing from the intake port, the plurality of flow path bodies including first axial ends and second axial ends that are positioned further from the fan than the first axial ends; and a mount provided in the housing between fan and the separator and including:

a mounting body having a top face and a mounting space defined therein;

a plurality of openings in a bottom face of the mounting body and positioned to correspond to the first axial ends of the flow path bodies, the plurality of openings including at least one first opening in a first region of the bottom face and at least one second opening in a second region of the bottom face; and a filter positioned in the mount to filter air flowing to the fan and including:

a filter body located in the mounting space;

a first filter face positioned to face the bottom face of the mounting body to filter air flowing through the first opening; and a second filter face positioned on the filter body to divide the mounting space into a first space adjacent to the first region and a second space adjacent to the second region, wherein the second filter face filters air flowing through the second opening, wherein the first region is a region including a center of the bottom face of the mounting body, and the second region is a ring-shaped region surrounding the first region, and wherein the second opening includes at least two communicating holes, and the second filter face includes chamber forming walls provided on a side face of the filter body to form, respectively, filtering chambers, a quantity of the filtering chambers formed by the chamber forming walls being equal to a quantity of communicating holes in the mounting space.

14. The cleaner of claim 13, wherein the filtering chambers are provided to define respective spaces that are independent of each other.

15. The cleaner of claim 13, wherein each of the chamber forming walls is shaped to be bent toward a center of the filter body.

16. The cleaner of claim 15, further comprising one or more guides positioned in the mount to divide each of the filtering chambers into at least two spaces, wherein pairs of the communicating holes included in the second opening are separated from each other by one of the guides.

* * * * *